United States Patent [19]

Hallinger et al.

[11] 3,975,901

[45] Aug. 24, 1976

[54] DEVICE FOR REGULATING TURBINE BLADE TIP CLEARANCE

[75] Inventors: Claude Christian Hallinger, l'Hay-les-Roses; Robert Kervistin, Melun, both of France

[73] Assignee: Societe Nationale d'Etude et de Construction de Moteurs d'Aviation, Paris, France

[22] Filed: July 22, 1975

[21] Appl. No.: 598,113

[30] Foreign Application Priority Data

July 31, 1974 France ..... 74.27209

[52] U.S. Cl. ..... 60/39.14; 60/39.66; 415/115; 415/117

[51] Int. Cl.[2] ..... F02C 7/18

[58] Field of Search ..... 60/39.66, 39.14; 415/115, 116, 117, 134

[56] References Cited

UNITED STATES PATENTS

| | | | |
|---|---|---|---|
| 3,169,366 | 2/1965 | Clark et al. | 415/116 |
| 3,583,824 | 6/1971 | Smuland et al. | 60/39.66 |
| 3,584,458 | 6/1971 | Wetzler | 60/39.66 |
| 3,736,069 | 5/1973 | Beam et al. | 60/39.66 |

*Primary Examiner*—Carlton R. Croyle
*Assistant Examiner*—Robert E. Garrett
*Attorney, Agent, or Firm*—Watson, Cole, Grindle & Watson

[57] ABSTRACT

A device for automatically regulating the clearance between the tips of the rotor blades of a turbine, particularly of a gas turbine, and the adjacent wall of a turbine stator, comprising means for directing a gaseous flow against the said wall to regulate its temperature. This gaseous flow is obtained from a proportioner including at least two inlet passages connected to sources of gas at different temperatures and controlled by the thermal expansion of an obturator responsive to the temperature of fluid passing through the turbine, so as to reduce the temperature of the said gaseous flow as the obturator expands, in order to cool the stator in stable conditions and to heat it in transitory conditions.

11 Claims, 14 Drawing Figures

DEVICE FOR REGULATING TURBINE BLADE TIP CLEARANCE

Figure 1:
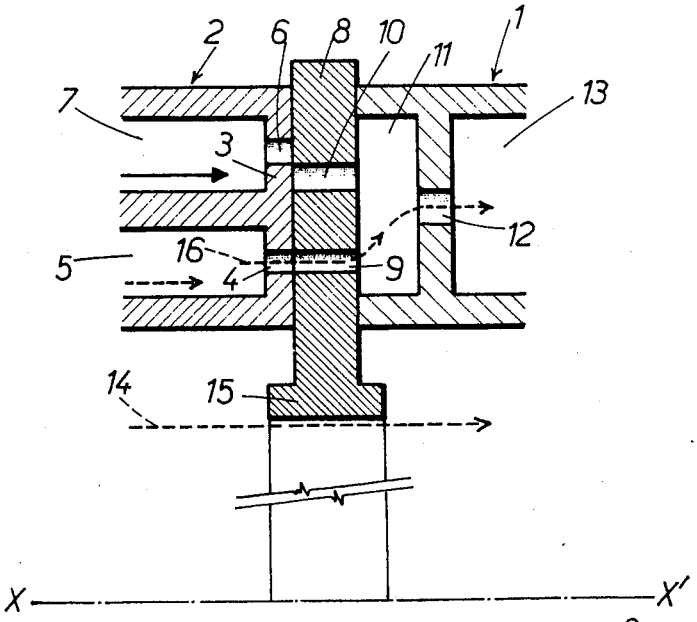

This invention relates to turbines and is concerned with adjustment of the clearance between the tips of the blades and the stator of a turbine, by cooling the stator, i.e. the rings, the segments or the casing supporting the segments, which constitute the parts of the stator which are located opposite to the rotor wheels.

The output of a turbine, particularly of a gas turbine, in stable conditions is dependent on the clearance between the tips of the blades and the stator of the turbine. But, in stable conditions, this clearance is itself dependent on the clearance existing during the critical or transitory periods of operation of the turbine, i.e. the periods of starting, acceleration, and deceleration. In fact, during starting or acceleration the turbine blades expand more rapidly than the casing; the clearance when cold should, therefore, be sufficient to ensure that there will remain during a starting or acceleration period a minimum clearance avoiding any risk of contact between the blades and the stator. In stable conditions, when the stator has had time to expand, the clearance then becomes too large and deteteriously affects the output of the turbine.

It is known to cool the stator by submitting it permanently to the impact of a relatively cold gas so as to limit the degree of expansion of its elements and thus in stable conditions to restore the clearance to a lower value. The output of the turbine can thus be improved but the impact of the cold gas slows down expansion of the stator further during starting and acceleration so that the minimum clearance when cold or during assembly has to be calculated with a reasonable degree of tolerance. Thus, in stable conditions, the clearance cannot be reduced as much as one could have hoped. Moreover, if the blades cool rapidly when decelerating, the same rate of cooling is not obtained for the turbine disc supporting these blades which has a large thermal inertia; in contrast, the stator which is submitted to the impact of the relatively cold gas cools fairly quickly. The assembly of disc and blades contracts more slowly than the stator and the clearance could become insufficient during deceleration. In stable conditions this imposes a limitation on the reduction in clearance which can be achieved.

The present invention has as its object the provision of a device permitting minimisation of the clearance in stable conditions while maintaining sufficient clearance during the transitory periods.

The device according to the invention comprises means for directing a gaseous flow against the wall of the stator located opposite the turbine blades, said flow being supplied by a proportioner comprising at least two inlet passages connected to sources of gas at different temperatures and controlled by the thermal expansion of an obturator responsive to the temperature of fluid passing through the turbine so as to reduce the temperature of the said gaseous flow when said obturator expands and thus cool the stator in stable conditions and heat it in transitory conditions.

The proportioner may comprise a first and a second inlet passage connected respectively to a source of hot gas and to a source of cold gas; the obturator, when it is cold, uncovers the first passage and shuts the second while, when it is hot, the obturator uncovers the second passage and shuts the first. The section of the passage which is connected to the source of gas which is colder may advantageously be regulated by the thermal expansion of a second obturator with a thermal inertia lower than that of the first obturator under the action of the fluid passing through the turbine so that the section for the supply of cold gases is rapidly closed.

In one embodiment, the proportioner includes an annular wall disposed transversely to the axis of the turbine, each inlet passage comprising a plurality of orifices arranged in a ring in this wall, and the obturator is an annular disc mounted so that it can expand freely against one face of the annular wall. The second obturator could be in the form of a second annular disc mounted so that it can expand freely against the other face of the transverse wall.

Figure 1A:
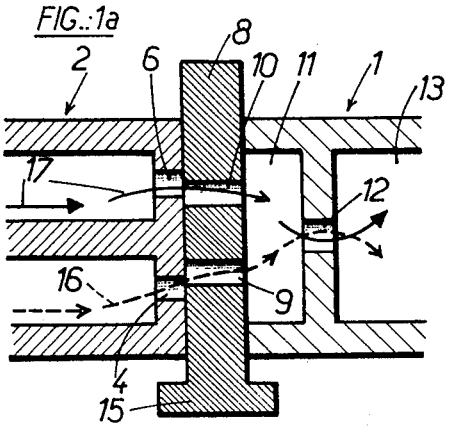
Figure 1B:
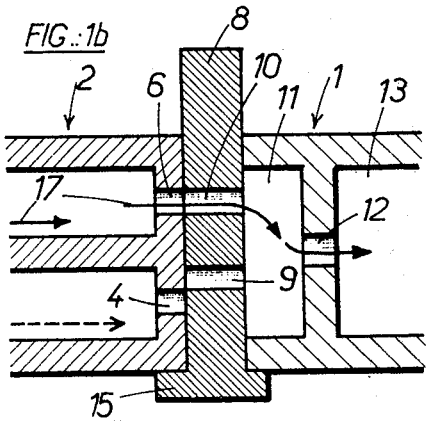
Figure 2:
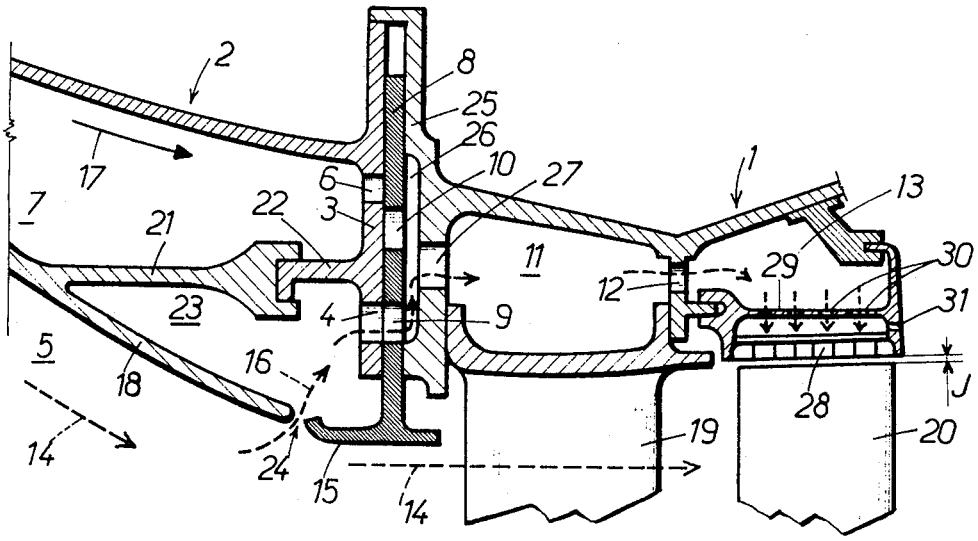
Figure 2A:
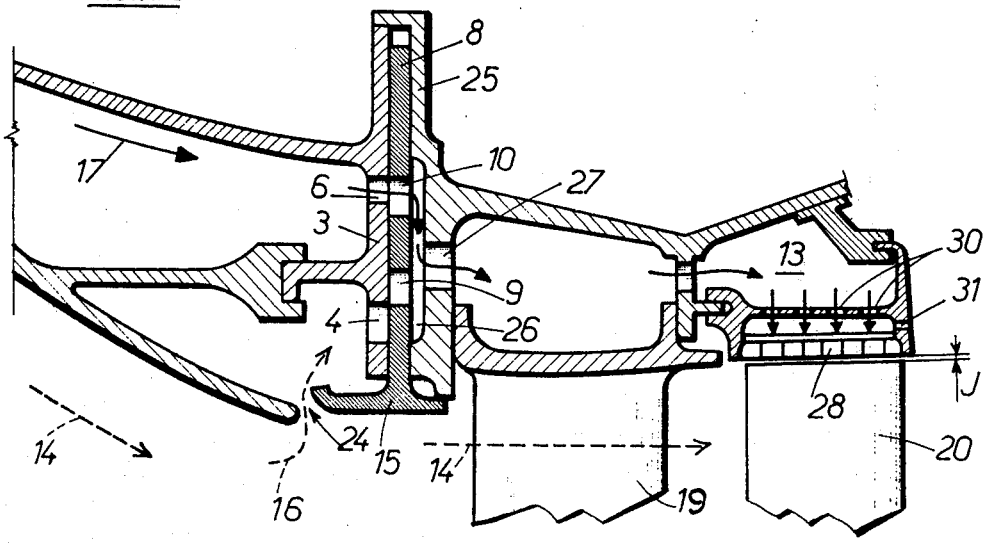
Figure 3:
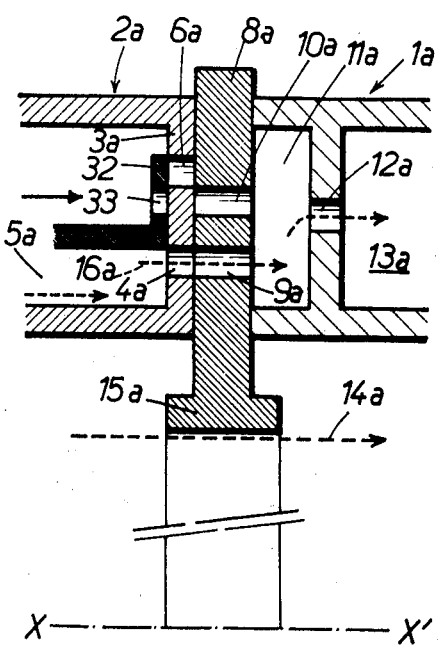
Figure 3A:
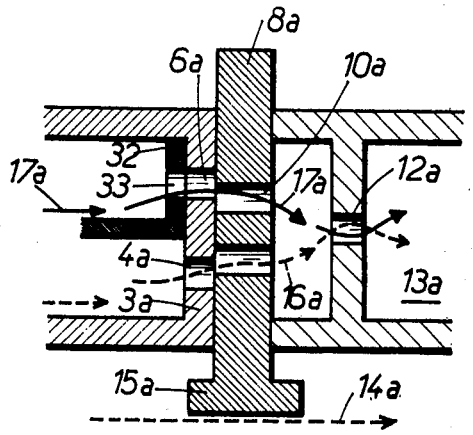
Figure 3B:
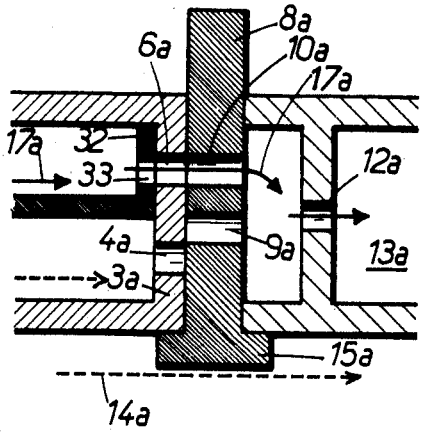
Figure 3C:
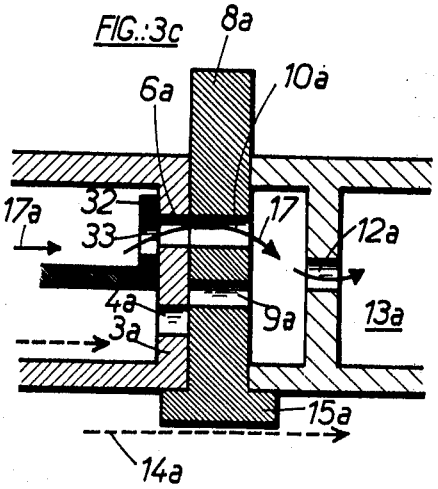
Figure 4:
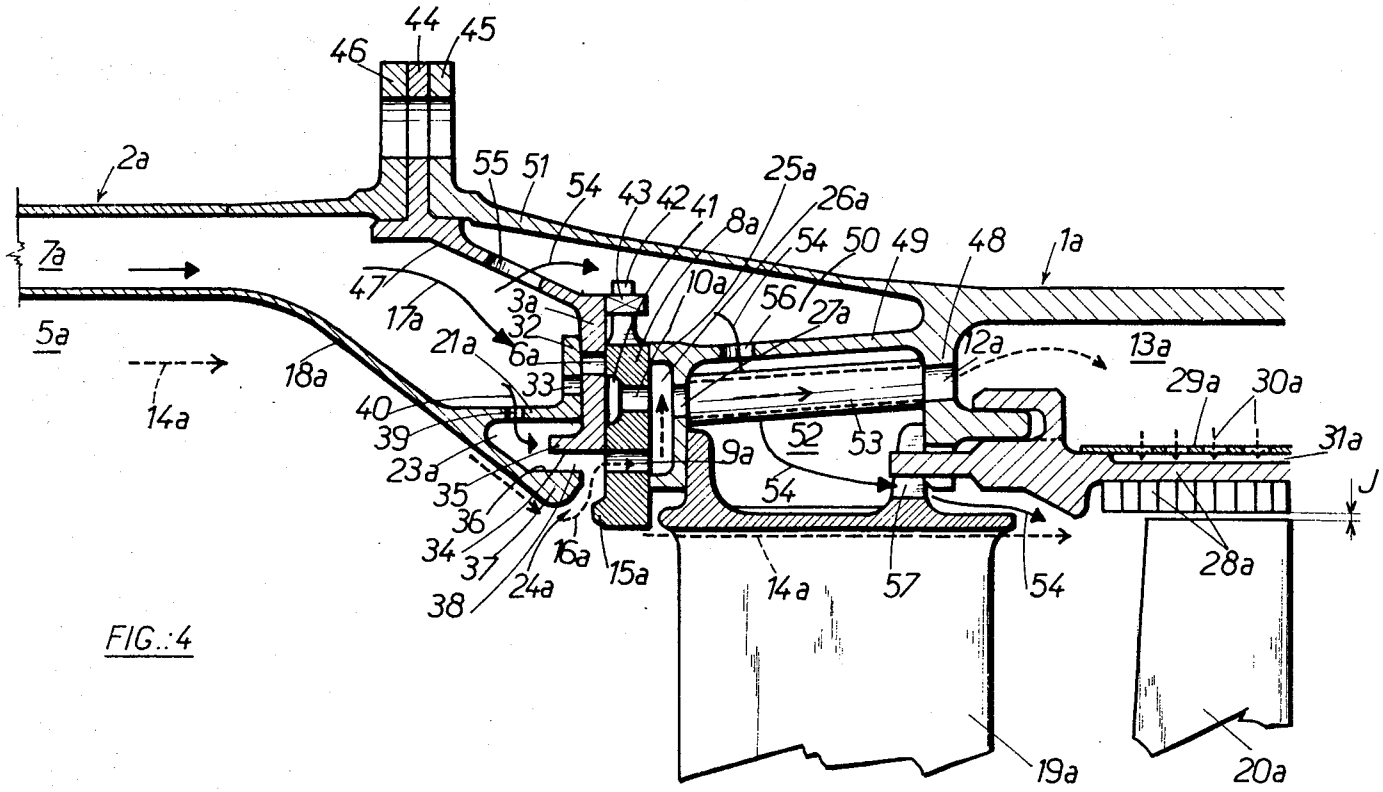
Figure 4A:
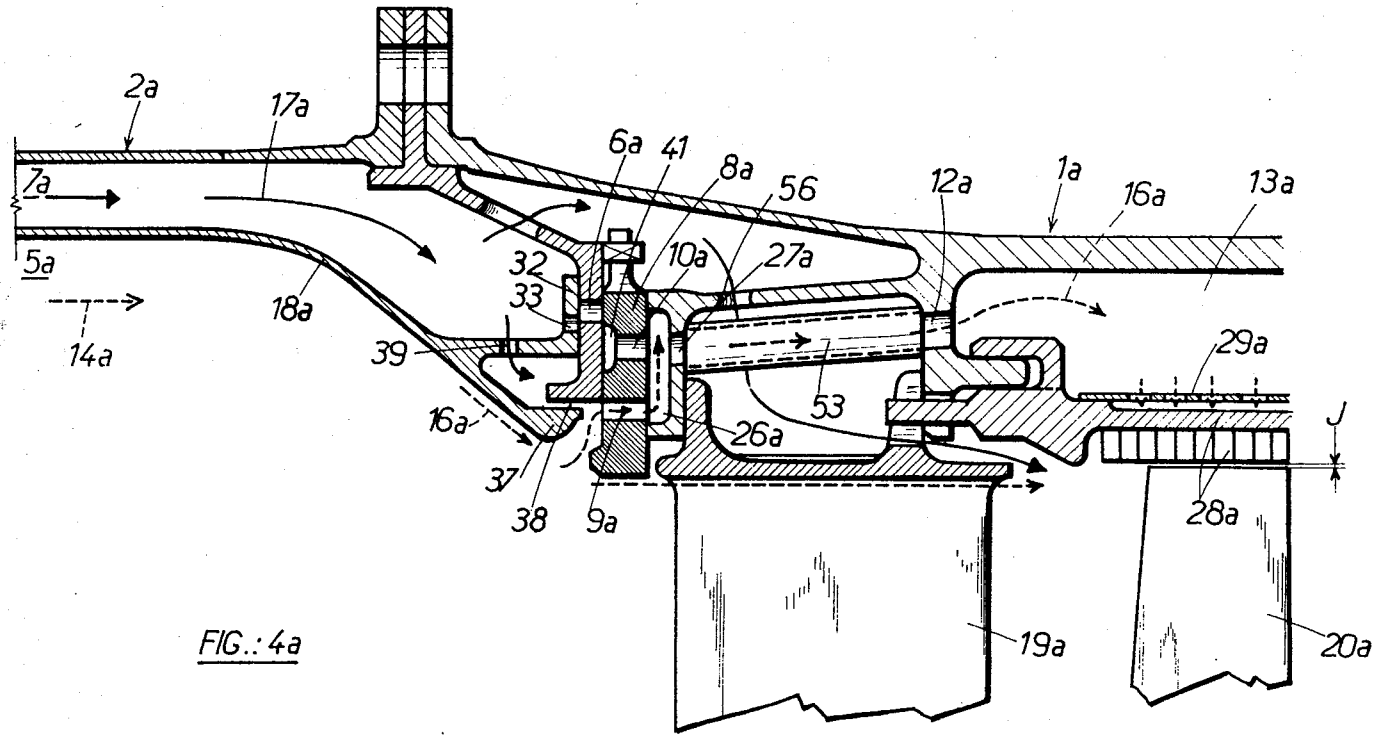
Figure 4B:
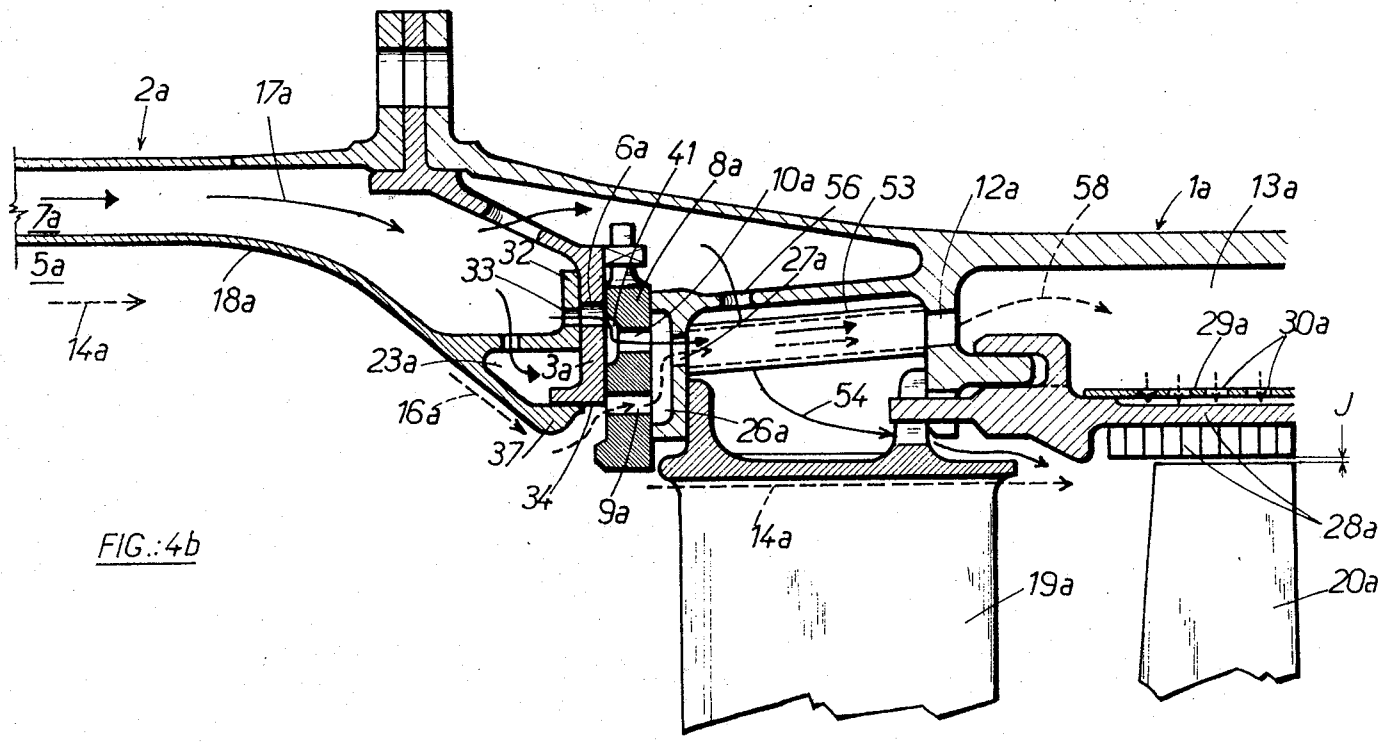
Figure 4C:
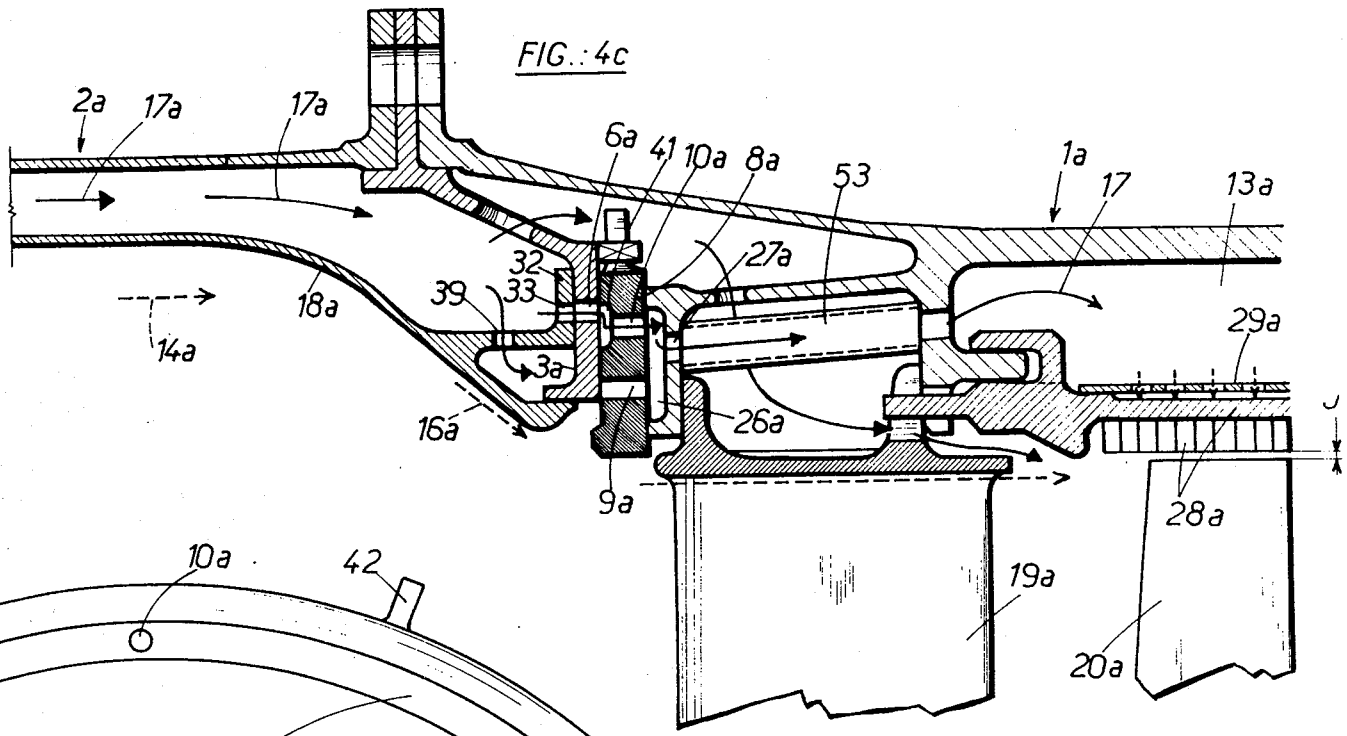
Figure 5:
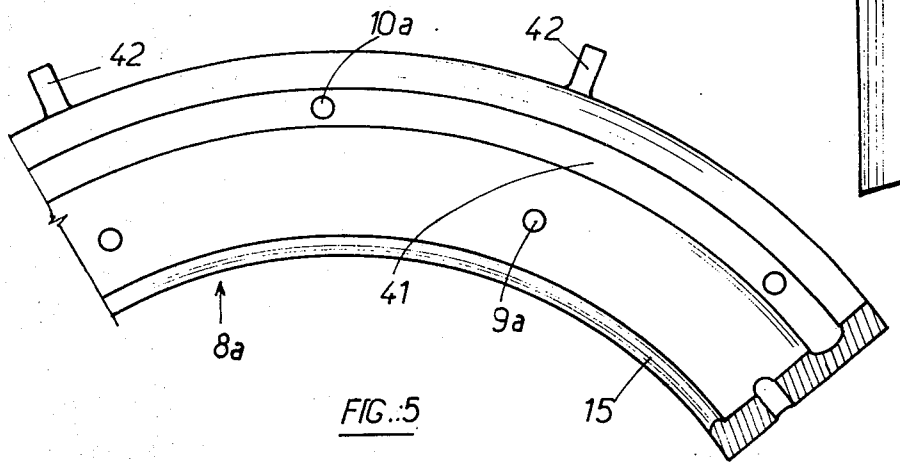

The invention will now be described by way of example with reference to the accompanying drawings which illustrate a number of embodiments of the invention and in which:

FIGS. 1, 1*a* and 1*b* illustrate schematically the operation of a first embodiment of annular proportioner, FIG. 2 is an axial half-sectional view of a part of a gas turbine provided with a regulating device including a proportioner according to FIGS. 1, 1*a* and 1*b*, FIG. 2*a* is a view similar to FIG. 2, showing the components of the device in the positions which they occupy when the turbine is operating in stable conditions, FIGS. 3, 3*a*, 3*b* and 3*c* are views similar to FIGS. 1 to 1*b*, illustrating schematically the operation of another type of annular proportioner according to the invention, FIG. 4 is a view similar to FIG. 2, showing a turbine incorporating a proportioner according to FIGS. 3 to 3*c*, FIGS. 4*a*, 4*b* and 4*c* are views similar to FIG. 4 showing the positions occupied by the components of the proportioner when the turbine is operating in different conditions, and FIG. 5 is a partial view of the face of the annular obturator which is turned towards the left of FIG. 4.

FIG. 1 shows schematically a first part 1 of the casing of a turbine and a part 2 of the casing of combustion chamber of the gas turbine which has a longitudinal axis X-X'. The casing part 2 comprises an annular wall 3 disposed transversely to the axis X-X' and having a first series of orifices 4 arranged on a circular path and communicating with a source of hot gas 5, and having a second series of openings 6 arranged on a circular path of larger radius than the openings 4 and communicating with a source of cold gas 7. Between the casing parts 1 and 2 is located an obturator in the form of an annular disc 8 having two series of holes 9 and 10 disposed in circular paths. The disc 8 can expand freely while sliding along the wall 3. The two series of holes 9, 10 open into a chamber 11 of the casing part 1, and this chamber 11 communicates with a chamber of larger dimensions 13 by means of an orifice 12 to discharge into the chamber 13 a flow of gas which will act to regulate the temperature of the wall of the turbine stator as will be explained later.

When the turbine is in operation, the combustion chamber (not shown) discharges into the casing of the turbine a current of hot gas 14 which sweeps the interior walls of the casings 1 and 2 and which envelops a flange 15 provided at the inner periphery of the annular disc 8. The disc 8 is made of a material having a coefficient of expansion greater than that of the materials which form the casing parts 1 and 2, so that the degree of differential expansion between the annular disc 8 and the casing parts increases with an increase in the temperature of the turbine. The holes 9 and 10 are disposed in the annular disc 8 so as to occupy the position shown in FIG. 1 (holes 9 register with orifices 4 and holes 10 are offset in relation to the orifices 6 so that the latter are shut off by the disc 8) when the turbine is cold, and the arrangement shown in FIG. 1*b* (holes 10 register with orifices 6 and holes 9 are offset in relation to the orifices 4 so that the latter are cut off by the disc 8) is obtained when the turbine operates in stable conditions (maximum temperature).

FIG. 1 shows the device when the turbine has stopped and is starting; during this period, the cold gas cannot reach the chambers 11 and 13, but the hot gas passes in the direction indicated by the arrows 16 through the orifices 4 and the holes 9 and reaches the chamber 13, where it acts to reheat the casing. The passage for the flow of hot gas then remains partially open for several seconds. At the end of a certain period of operation the components of the proportioner occupy the positions shown in FIG. 1*a*, in which the holes 9 and 10 partially uncover the orifices 4 and 6; the cold gas and the hot gas can thus pass through the respective orifices 4 and 6, as indicated by the arrows 16 and 17, so that a mixture of hot gas and cold gas reaches chamber 13. After another few seconds of operation (FIG. 1*b*), the annular disc 8 continuing to expand progressively closes the orifices 4 and completely opens the orifices 6 which provide for the flow of the cold gas as indicated by the arrows 17 to send it into the chamber 13 where it acts to cool the casing. During the deceleration phase of the turbine, the annular disc 8, by contracting more rapidly than the casing parts, again allows the passage of the hot gas towards the turbine casing part 1 in order to reheat it.

FIG. 2 shows a part of a gas turbine provided with a regulating device comprising a proportioner as shown schematically in the preceding figures, those components which have the same function being designated by the same reference numerals. The source of hot gas 5 is constituted by the combustion chamber part of the wall of which is shown at 18 and which supplies the flow of hot gas 14 passing through the turbine. At 19 the distributor of the turbine is seen and at 20 its rotor blades which are fixed on a turbine disc not shown. The wall 18 separates the combustion chamber 5 from an annular volume 7 which forms the source of cold gas, being supplied with cold air drawn from the compressor, not shown, of the gas turbine. The wall 18 is integral, moreover, with a partition element 21 which is substantially cylindrical and connected to another substantially cylindrical partition element 22 emanating from the wall 3, between the series of orifices 6 and 4, thus separating the volume 7 from an annular volume 23 which communicates with the combustion chamber 5 through an annular slit 24 contained between the lower edge of the wall 18 and the flange 15 of the annular disc 8. Centering means of known type (not shown) of which an example is illustrated in FIG. 4, allow the annular disc 8 to expand while remaining coaxial with the turbine.

The flange 15 forms a blade of a general, cylindrical shape which is enveloped by the flow of hot gas 14, and the obturator in the form of the annular disc 8 can expand radially while sliding between the wall 3 and a parallel wall 25 of the casing of the turbine. This wall 25 forms an annular chamber 26 into which the holes 9 and 10 open and which communicates with the chamber 11 through a circular series of orifices 27. The chamber 13 of the turbine is separated from a cylindrical wall 28 surrounding the blades 20 of the turbine, by a cylindrical partition 29 formed with orifices 30. The cold or hot fluid entering chamber 13 passes through these orifices 30 to form jets which impinge on the cylindrical wall 28 and then escape through openings 31 which communicate with the interior of the turbine by means not shown.

The clearance J between the tips of the blades 20 and the cylindrical partition 28 is of the order of 1 mm. when the turbine is cold. When starting the turbine, the blades 20 would expand more rapidly than the wall 28 in the absence of the regulating device but, because the annular disc 8 is relatively cold, only the flow of hot gas 16 can penetrate into the chamber 13 to reheat the wall 28 and to re-establish the clearance J, passing through the slit 24, the orifices 4, the holes 9, the chamber 26, the orifices 27, the chamber 11 and the orifices 12.

During the acceleration phase of operation of the turbine, it is a mixture of progressively colder gas which reaches the chamber 13 as has been explained above with respect to FIG. 1*a*. However, it is possible to choose the masses and the coefficients of expansion of the disc 8 and the walls 3 and 25 so that the holes 9 remain facing the orifices 4 for the whole of the time that it is necessary to reheat the wall 28 drastically to maintain the clearance J above a certain limiting value.

After a certain time of operation, the annular disc 8 will have expanded more than the partitions 3 and 25, and the orifices 6 only will be exposed. This arrangement, which has been described with respect to FIG. 1*a*, is shown in FIG. 2*a*. The flow of cold gas 17 passes through the orifices 6, the holes 10 and the chamber 26, and reaches the chamber 13 by means of the path which the hot flow 16 followed previously. The jets of cold air passing through the orifices 30 cool the wall 28 and prevent the heat from being communicated to the casing of the turbine, so that the clearance J is brought back to 0.07 mm.

During the deceleration phase the whole of the turbine disc (not shown) and the blades 20 would cool more slowly than the casing of the turbine in the absence of the regulating device so that the clearance J would become too low. However, the annular disc 8 cools equally and progressively reopens the orifices 4 while progressively closing the orifices 6 again so that the flow of gas reaching the chamber 13 and impinging on the wall 28 progressively reheats and slows down the contraction of the wall 28, so that the clearance J is maintained above a dangerous value.

It will be noted that the example described in FIGS. 2 and 2*a* could be modified by replacing the chamber 13 by tubular pipes surrounding the casing and formed with perforations allowing direct cooling by impact of gas on the casing.

FIG. 3, in which the components having the same function as in FIG. 1 are designated by the same reference numerals with the addition of the suffix *a*, shows a proportioner comprising a second annular obturator 32 in the form of a disc having also a coefficient of thermal expansion greater than the wall 3*a* but having a thermal inertia lower than the disc 8*a*, and being able to expand freely while sliding against the face of the wall 3*a* opposite the face against which the disc 8*a* slides. This second disc 32 has a circle of holes 33 which are disposed so as to be offset in relation to the orifices 6*a* so that the latter are covered by the disc 32 when the gas turbine is cold and so as to be situated facing these orifices 6a when the disc 32 has expanded completely differentially during operation of the turbine in stable conditions (the position shown in FIG. 3b).

When the turbine has stopped (FIG. 3), only the passage 4a, 9a is open to permit the hot gas flow 16a as in the case of FIG. 1. The passage for the hot gas flow then remains wide open for a few minutes. FIG. 3a shows the positions occupied by the discs 8a and 32a after a certain time of operation of the turbine, the disc 8a being expanded partially as in the case of FIG. 1a so as to partially expose the orifices 6a and to partially cover the orifices 4a, while the disc 32, because of its lower thermal inertia, is completely expanded so that the holes 33 are located facing the orifices 6a and expose them completely; the chamber 13a receives a mixture of hot gas 16a and cold gas 17a as in the case of FIG. 1a. Several minutes later, the disc 8a which is continuing to expand completely closes the passage for the flow of hot gas and opens completely the passage for the flow of cold gas (the position shown in FIG. 3b); the chamber 13a receives, therefore, only cold gas 17a, and cooling of the casing of the turbine is the maximum as in the case of FIG. 1b.

At the beginning of the deceleration phase of operation of the turbine, the temperature of the combustion chamber is rapidly reduced and the casing could contract too rapidly. This possibility is avoided by the disc 32 which, by contracting more quickly than the disc 8a because of its lower thermal inertia, reduces the passage of cold gas 17a as seen in FIG. 3c. The disc 8a then contracts and progressively returns to the position which it occupied when starting (FIG. 3) thus putting the source of hot gas 5a in communication with the casing of the turbine in order to reheat it.

FIG. 4 shows a gas turbine similar to that which has been described above with respect to FIG. 2 and the components having the same function are designated by the same reference numerals with the addition of the suffix *a*. However, the device for regulating the clearance J between the tips of the blades of turbine 20a and the wall 28a of the casing 1a comprises a proportioner similar to that which has been described with regard to FIGS. 3 to 3c, the second annular disc 32 being in the form of a flange at the end of the partition 21a which is integral with the wall 18a of the combustion chamber 5a.

The annular transverse wall 3a of the combustion chamber has a single ring of openings 6a and its inner surface 34, when the turbine is cold (arrangement shown in FIG. 2), is level with the outer edge of the ring of holes 9a. Wall 3a is, moreover, provided with an interior cylindrical edge flange 35 which projects into the volume 23a, and the cylindrical inner surface 34 is situated radially facing the outer cylindrical surface 36 of an annular flange 37 formed at the lower end of the wall 18a of the combustion chamber.

Annular flange 37 cooperates with the flange 15a of the disc 8a to define a slit 24a; flange 15a is a plain annular flange directed towards the inlet end of the turbine and forming a deflector which assists the passage of hot gases 14a into the slit 24a to flow along the path indicated by the arrow 16a. The outer surface 36 of the flange 37 defines, with the inner surface 34 of the wall 3a, an annular passage 38, which provides communication between the slit 24a and the volume 23a. Moreover, the partition 21a is formed with a series of orifices 39 through which cold air may pass as indicated by the arrow 40 from the volume 7 into the volume 23a so as to form a layer of cold air against the flange 35 of the wall 3a, shielding this wall from the gases passing at 16a; thus the degree of expansion of the wall 3a is reduced below a level which might otherwise render insufficient the differential thermal expansion of the disc 8a.

The cold air thus discharged at 39 in the volume 23a crosses the annular passage 38 and mixes with the hot gas indicated at 16a. Therefore, the orifices 39 may be dimensioned so as to adjust, if necessary, the temperature of the hot gas which reaches the chamber 13a. In addition, the end portion of the wall 18a expands as a whole so that the flange 37 approaches the inner surface 34 of the partition 3a, reducing the cross-sectional area of the annular passage 38 until cancelling it completely as the disc 32 expands as seen in FIGS. 4a and 4b. Moreover, the flange 37 moves away from the flange 15a, increasing the cross-sectional area of the slit 24a (FIG. 4a), since the disc 32 expands more quickly than the disc 8a. The flange 15a subsequently approaches the flange 37 when the disc 8a expands thereby reducing the cross-sectional area of the slit 24c (FIG. 4c). These characteristics can be used to advantage to modulate the flow and the temperature of the hot gas passing into the holes 9a.

As can be seen from FIGS. 4 and 5, the holes 10a, from the upper part of the turbine, lead into a circular slot 41 formed in the face of the disc 8a sliding against the wall 3a. The disc 8a is provided with a plurality of centering guides or fingers 42 projecting from its outer periphery which are engaged in castellations on a rib 43 of the wall 3a, so that the disc 8a can expand while remaining coaxial with the turbine.

As in the embodiment of FIG. 2, the disc 8a expands while sliding between the walls 3a and 25a. The transverse wall 3a forms part of a ferrule comprising a flange 44 which is held between flanges 45 and 46 of casing parts 1a and 2a, and a frusto-conical junction portion 47 connecting the flange 44 to the wall 3a. The transverse wall 25a is connected to end wall 48 of the chamber 13a by a junction piece 49 so that an annular chamber 50 is formed between the junction pieces 47 and 49 and the outer wall 51 of the casing part 1a, and so that another annular chamber 52 is formed between the junction piece 49 and the distributor 19a on the one hand, and the walls 25a and 48 on the other hand. This chamber 52 is intersected by tubes 53 connecting the orifices 27a to the orifices 12a and through which the hot or cold gas passes from the chamber 26a into the chamber 13a. Cold air passes in the direction indicated by the arrow 54 from the volume 7a into the chamber 50 through the openings 55 of the junction piece 47, from the chamber 50 into the chamber 52 through the openings 56 of the junction piece 49 and is discharged from the chamber 52, through the openings 57, into the turbine around the stream of hot gases 14a in a well known manner.

FIG. 4 shows the components in the positions which they occupy when starting the turbine. The holes 33 of the disc 32 are offset in relation to the orifices 6a, so that the entrance to these orifices is blocked by the disc 32. The slot 41 is formed in disc 8a and is positioned so that the outer edge of this slot 41 comes into register with the inner edge of the orifices 6a so that the outlets of these orifices are blocked by the disc 8a. In contrast, the holes 9a are exposed so that the hot gases flowing as indicated at 16*a* pass through the slit 24*a*, the holes 9*a*, the chamber 26*a*, the orifices 27*a*, the tubes 53 and the orifices 12*a* into the chamber 13*a* from where they reheat the wall 28*a* of the casing part 1*a* in the manner described with respect to FIG. 2. At the beginning of a starting operation the clearance J is of the order of 1 mm.

FIG. 4*a* shows the positions of the components 20 seconds after the beginning of the starting procedure. During these twenty seconds the disc 8*a*, being still relatively cold, remains in the position which it occupied originally but the lower end of the wall 18*a*, which has a low thermal inertia, expands rapidly so that the flange 37 begins to close the passage 38 and to enlarge the slit 24*a*. This has the effect of increasing the rate of flow of hot gases indicated at 16*a* entering the holes 9*a* and of reducing the flow of cold air 39 crossing the passage 38 to mix with this hot air. The increased volume of hot gas flowing into the chamber 13*a* at a higher temperature reheats the wall 28*a* more rapidly so that the wall 28*a* moves clear of the tips of the blades 20*a* of the turbine which, without this, would expand more rapidly than this wall 28*a*.

The positions of the components one hundred seconds after starting are shown in FIG. 4*b*. The downstream end of the wall 18*a* has reached its position of maximum expansion so that the holes 33 of the disc 32 have moved into coincidence with the orifices 6*a* of the wall 3*a* and so that the flange 37 has closed the passage 38 completely, thus closing the outlet for the flow of cold air contained in the volume 23*a*. On the other hand, the disc 8*a* has expanded so that the edge 34 of the partition wall 3*a* again partially covers the holes 9*a* and so that the outer edge of the slot 41 partially exposes the orifices 6*a*. This has the effect of reducing the flow of hot air indicated at 16*a* through the holes 9*a* and allowing the cold air indicated at 17*a* to pass through the holes 33, the orifices 6*a*, the slot 41 and the holes 10*a* into the chamber 26*a*. This cold air indicated at 17*a* mixes with the hot air indicated at 16*a* and the cooler mixture 58 reaches the chamber 13*a* so that the wall 28*a* does not continue to expand.

FIG. 4*c* shows the positions of the components when the turbine is functioning in stable conditions possibly about five minutes after starting. The disc 8*a* has continued to expand so that the holes 9*a* are completely blocked by the partition wall 3*a* and so that the orifices 6*a*, the entrances to which are completely exposed by the holes 33, open throughout their cross-sectional areas into the slot 41. Only the cold air indicated at 17*a* reaches the chamber 13*a*, drastically cools the wall 28*a*, and prevents the heat from being transmitted to the casing part 1*a* so that the clearance J is returned to a very low value, of the order of 0.07 mm.

At the time of deceleration the whole of the disc of the turbine (not shown) and the blades of the turbine cool more slowly than the wall 28*a* of the casing part 1*a*. However, the clearance J is not liable to become too low due to a too rapid contraction of the wall 28*a* because the end of the wall 18*a* of the combustion chamber, which has a lower thermal inertia than the disc 8*a* and provides the disc 32, contracts immediately and partially covers the orifices 6*a* thus reducing the rate of flow of cold air as indicated at 17*a*. Cooling of the wall 28*a* is thus slowed down while the disc 8*a*, by contracting, then covers the holes 9*a* to allow the hot gas to flow into the chamber 13*a* to re-establish the normal clearance between the wall 28*a* and the tips of the blades 20*a* of the turbine.

Instead of giving the annular obturator disc a coefficient of thermal expansion greater than that of the wall against which it is mounted, it could be given a coefficient of thermal expansion smaller than the latter by modifying the fluid flow circuits so as to cool the disc since it is the differential expansion between these two components which ensures satisfactory operation of the proportioner. In addition, the two circular series of holes in the annular disc 8 could be replaced by circular slits, assuring a large fluid flow rate for a relatively low displacement. Finally, it will be noted that the arrangement described could be employed for the temperature regulation of a turbine disc with the object of reducing thermal gradients in transitory conditions.

Application of the invention is not limited to gas turbines. The flow of fluid fed to a steamturbine, for example, could be used to ensure differential expansion of the obturator of a proportioner according to the invention, the heat transfer rate from the flow of steam to the obturator being lower in transitory conditions than in stable conditions.

We claim:

1. A device for regulating the clearance between the tips of the rotor blades of a turbine supplied with a hot fluid and the turbine stator facing the said blades, comprising a first source of gas suitable for supplying gas at a first temperature, a second source of gas suitable for supplying gas at a second temperature lower than the first temperature, a proportioner having a first and a second inlet passage and an outlet passage, means connecting the first inlet passage to the first source of gas and the second inlet passage to the second source of gas, an obturator capable of being expanded thermally to reduce the cross-section of the first inlet passage and to increase the cross-section of the second inlet passage, means whereby a portion of the obturator is contacted by said hot fluid, and means connecting the outlet passage to the said wall to direct thereupon a flow of gas issuing from the said outlet passage.

2. A device according to claim 1, comprising a further obturator having a thermal inertia lower than the said obturator and capable of being expanded thermally to increase the cross-section of the second inlet passage, and means whereby a portion of the further obturator is contacted by the said hot fluid.

3. A device according to claim 1, in which the proportioner comprises an annular wall extending transversely to the axis of the turbine, one at least of the inlet passages comprises a plurality of orifices arranged in a ring across the annular wall, and the obturator is an annular disc having a coefficient of thermal expansion different to that of the said annular wall, means being provided for mounting the said annular disc so that it can expand freely against a face of the said annular wall.

4. A device according to claim 3, in which the coefficient of thermal expansion of the annular disc is greater than that of the annular wall.

5. A device according to claim 2, in which the obturator comprises an annular wall extending transversely to the axis of the turbine, one at least of the inlet passages comprises a plurality of orifices arranged in a ring across the annular wall, and the obturator is an annular disc having a coefficient of thermal expansion different to that of the said annular wall, means being provided for mounting the said annular disc so that it can expand freely against one side of the said annular wall, the further obturator comprising a further annular disc having a coefficient of thermal expansion different to that of the said annular wall, amd means being provided for mounting the said further annular disc so that it can expand freely against the other side of the said annular wall.

6. A device according to claim 5, in which the coefficient of thermal expansion of the further annular disc is greater than that of the annular wall.

7. A device according to claim 3, and for a gas turbine having a combustion chamber, with an annular pipe surrounding the combustion chamber and a compressor provided for compressing air in the combustion chamber and in the annular pipe, in which the first source of gas is the combustion chamber and the second source of gas is the annular pipe.

8. A device according to claim 2, in which the annular disc has a flange which is enveloped by the said hot fluid.

9. A device according to claim 8, in which a tubular wall of the combustion chamber is so arranged that a slit is defined between the tubular wall and the flange on the disc, and means are provided connecting the slit to the first inlet passage.

10. A device according to claim 5, and for a gas turbine having a combustion chamber, with an annular pipe surrounding the combustion chamber, a compressor for compressing air in the combustion chamber and in the annular pipe, said device comprising a tubular wall between the combustion chamber and the annular pipe, and a flange associated with the tubular wall and the further annular disc.

11. A device according to claim 10, in which the annular flange of the tubular wall extends radially outwardly in relation to an inner peripheral edge of the annular wall, an annular passage being provided between the said annular flange and the said interior peripheral edge, and means provided connecting the annular passage to the annular pipe and to the first inlet passage, the arrangement being such that the said annular flange is applied against the said inner peripheral edge to close the said annular passage when the further annular disc and the tubular wall have expanded sufficiently to completely uncover the second inlet passage.

* * * * *